US009474394B2

(12) United States Patent
Komatsu et al.

(10) Patent No.: US 9,474,394 B2
(45) Date of Patent: Oct. 25, 2016

(54) DRAWER DEVICE AND MEDIUM TRANSACTION DEVICE

(71) Applicant: Oki Electric Industry Co., Ltd., Tokyo (JP)

(72) Inventors: Hirokazu Komatsu, Tokyo (JP); Masaaki Okamoto, Tokyo (JP); Ryousuke Kojima, Tokyo (JP); Shuuichi Hiratsuka, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/762,465

(22) PCT Filed: Dec. 12, 2013

(86) PCT No.: PCT/JP2013/083387

§ 371 (c)(1),
(2) Date: Jul. 21, 2015

(87) PCT Pub. No.: WO2014/155857

PCT Pub. Date: Oct. 2, 2014

(65) Prior Publication Data

US 2015/0359359 A1 Dec. 17, 2015

(30) Foreign Application Priority Data

Mar. 26, 2013 (JP) ..... 2013-064441

(51) Int. Cl.
*G07D 11/00* (2006.01)
*A47F 10/02* (2006.01)
(Continued)

(52) U.S. Cl.
CPC ..... *A47F 10/02* (2013.01); *A47B 88/02* (2013.01); *A47B 88/18* (2013.01); *A47B 96/00* (2013.01);
(Continued)

(58) Field of Classification Search
CPC ..... A47B 88/02; A47B 88/18; A47B 96/00; A47B 2088/026; A47B 96/16; A47F 9/00; A47F 10/02; E05B 65/461; E05B 65/46
USPC ..... 194/350; 312/139.1, 293.2, 302, 303, 312/311; 39/176, 181, 183, 184
See application file for complete search history.

(56) References Cited

U.S. PATENT DOCUMENTS 6,435,329 B1 * 8/2002 Amari ..... G07D 11/0039 194/206
6,719,120 B2 * 4/2004 Kato ..... B65H 29/006 194/206
2011/0198192 A1 8/2011 Togiya et al.

FOREIGN PATENT DOCUMENTS

JP H05-159136 A 6/1993
JP 2011-002921 A 1/2011
(Continued)

*Primary Examiner* — Mark Beauchaine
(74) *Attorney, Agent, or Firm* — Rabin & Berdo, P.C.

(57) ABSTRACT

The drawer device includes a casing including a specific internal space, a unit that adopts a pulled out state by being pulled out forward from a housed state of being housed in the casing, a subunit in the unit that adopts an open state in which the unit interior is open to the outside by swinging in an opening direction, and adopts a closed state in which the unit interior is closed off from the outside by swinging in a closing direction, and a push-in restriction section that restricts movement of the unit toward the casing when the unit is moved toward the casing with the subunit still in the open state. The subunit swings about a pivot point in the vicinity of a lower end portion of the unit.

11 Claims, 19 Drawing Sheets

(51) Int. Cl.

| | |
|---|---|
| ***A47B 88/18*** | (2006.01) |
| ***A47B 88/02*** | (2006.01) |
| ***A47B 96/00*** | (2006.01) |
| ***E05B 65/46*** | (2006.01) |

(52) U.S. Cl.

CPC ..... *E05B 65/461* (2013.01); *E05B 65/462* (2013.01); *G07D 11/0018* (2013.01); *G07D 11/0081* (2013.01); *A47B 2088/026* (2013.01)

(56) References Cited

FOREIGN PATENT DOCUMENTS

| | | | |
|---|---|---|---|
| JP | 2011-007302 | A | 1/2011 |
| JP | 2012-103890 | A | 5/2012 |
| JP | 2012-202029 | A | 10/2012 |

* cited by examiner

DRAWER DEVICE AND MEDIUM TRANSACTION DEVICE

TECHNICAL FIELD

The present invention relates to a drawer device and a medium transaction device, and is suitably applied, for example, to an automatic teller machine (ATM) that is inserted with a medium, such as a banknote, and that performs a desired transaction.

BACKGROUND ART

In automatic teller machines and the like used in financial institutions and the like, cash in the form of banknotes or coins, etc. is, for example, paid in by a customer, or paid out to the customer, according to contents of the transaction with the customer.

Such automatic teller machines include, for example, a banknote pay-in/pay-out port that accepts and dispenses banknotes for a customer, a classification section that classifies the denomination and authenticity of inserted banknotes, a temporary holding section that temporarily holds inserted banknotes, and denomination cassettes that store banknotes by denomination (see, for example, Japanese Patent Application Laid Open (JP-A) No. 2011-2921).

Such automatic teller machines include an automatic teller machine operated by a bank worker at a financial institution, as illustrated in FIG. 21. This automatic teller machine 501 is installed such that a rear portion of a casing 10 including an upper casing 20 and a lower casing 22 fits under a customer service counter provided in the financial institution.

Thus when a maintenance operation is performed on the inside of an upper unit 524 of the automatic teller machine 501, as illustrated in FIG. 21, a bank worker pulls the upper unit 524 out from the upper casing 20 toward the front, and swings a front panel 12 forward with respect to an upper drawer 25 about a pivot shaft 34, to open up the interior of the upper unit 524.

A front panel frame 552 that is a metal plate supporting the front panel 12 is attached to the inside of the front panel 12, and the pivot shaft 34 is inserted through a front end lower end portion of the front panel frame 552 and a front end portion of the upper drawer 25.

A stay 560 is attached to the front panel frame 552 so as to be capable of swinging, and the stay 560 slides in the front-rear direction along a stay bracket gutter 66 of a stay bracket 64 provided to the upper drawer 25 through a stay shoulder stud 68.

When the front panel 12 is opened, the stay shoulder stud 68 makes contact with a front end of the stay bracket gutter 66, restricting the clockwise swinging of the front panel 12, and retaining the front panel 12 in that position.

In such an automatic teller machine, the pivot shaft 34 not inserted through the immediate vicinity of an end face of the front end lower end portion of the front panel frame 552 in order to preserve strength in portions of the front panel frame 552 in the vicinity of the pivot shaft 34. Namely, in the front panel frame 552, a projection 54 having a specific area in a side view is formed at a lower side portion of the pivot shaft 34.

Thus, as illustrated in FIG. 21, when the front panel 12 is opened, the projection 54 projects out further downward than an upper end face of the front of the strong lower casing 22 in which banknote cassettes and the like are housed.

Moreover, in the automatic teller machine 501, from the state illustrated in FIG. 21, when the front panel 12 is closed and an upper unit 24 is pushed in to a specific position in the upper casing 20, the front panel frame 552 is not inserted to the lower side of a top plate of the upper casing 20.

SUMMARY OF INVENTION

Technical Problem

Accordingly, when a bank worker pushes the upper unit 524 into the upper casing 20 with the front panel 12 still in an open state, the projection 54 of the front panel 12 contacts the lower casing 22 as illustrated in FIG. 21, and there is concern that the front panel 12 may be damaged.

In consideration of the above, the present invention proposes a drawer device and a medium transaction device in which reliability of damage prevention can be increased.

Solution to Problem

In order to solve the above issue, the drawer device of the present invention includes a casing including a specific internal space, a unit that adopts a pulled out state by being pulled out forward from a housed state of being housed in the casing, a subunit on a front face of the unit that adopts an open state in which the unit interior is open to the outside by swinging in an opening direction, and adopts a closed state in which the unit interior is closed off from the outside by swinging in a closing direction, and a push-in restriction section that restricts movement of the unit toward the casing when the unit is moved toward the casing with the subunit still in the open state.

In this drawer device, the push-in restriction section enables the subunit to be prevented from colliding with the casing.

In order to solve the above issue, the medium transaction device of the invention includes an upper casing including a specific interior space, a lower casing that is disposed below the upper casing and that internally stores a medium cassette that houses a paper sheet shaped medium, a unit that adopts a pulled out state by being pulled out forward from a housed state of being housed in the upper casing, a customer interface that is provided to the unit and that receives transactions related to the medium, a subunit on a front face of the unit that adopts an open state in which the unit interior is open to the outside by swinging in an opening direction, and adopts a closed state in which the unit interior is closed off from the outside by swinging in a closing direction, and a push-in restriction section that restricts movement of the unit toward the upper casing when the unit is moved toward the upper casing with the subunit still in the open state.

In this medium transaction device, the push-in restriction section enables the subunit to be prevented from colliding with the casing.

Advantageous Effects of Invention

According to the present invention, a drawer device and a medium transaction device can be achieved in which a push-in restriction section can prevent a subunit from colliding with a casing, and that enable an increase in reliability of damage prevention

DESCRIPTION OF EMBODIMENTS

Explanation follows regarding embodiments of the invention (referred to below as exemplary embodiments), with reference to the drawings.

Figure 1:
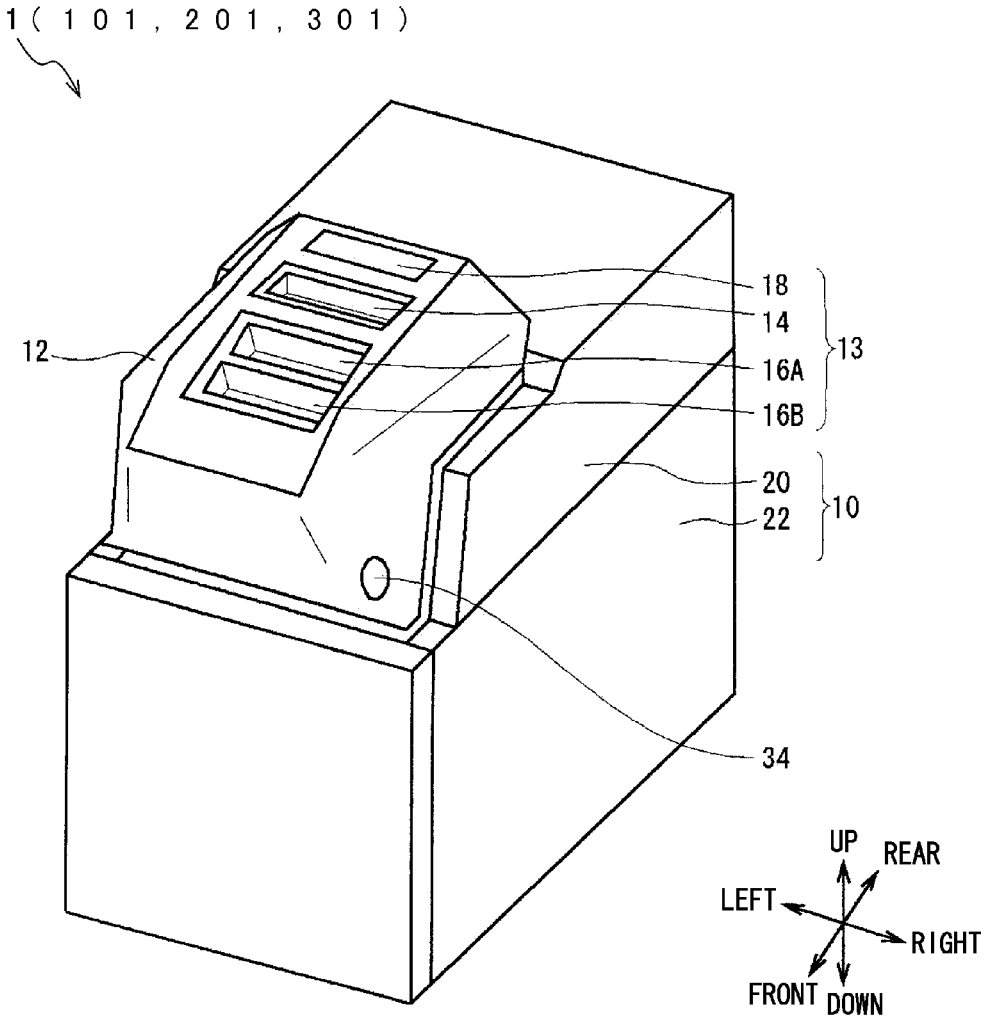
FIG. 1 is a perspective view illustrating a configuration of an automatic teller machine.
Figure 2:
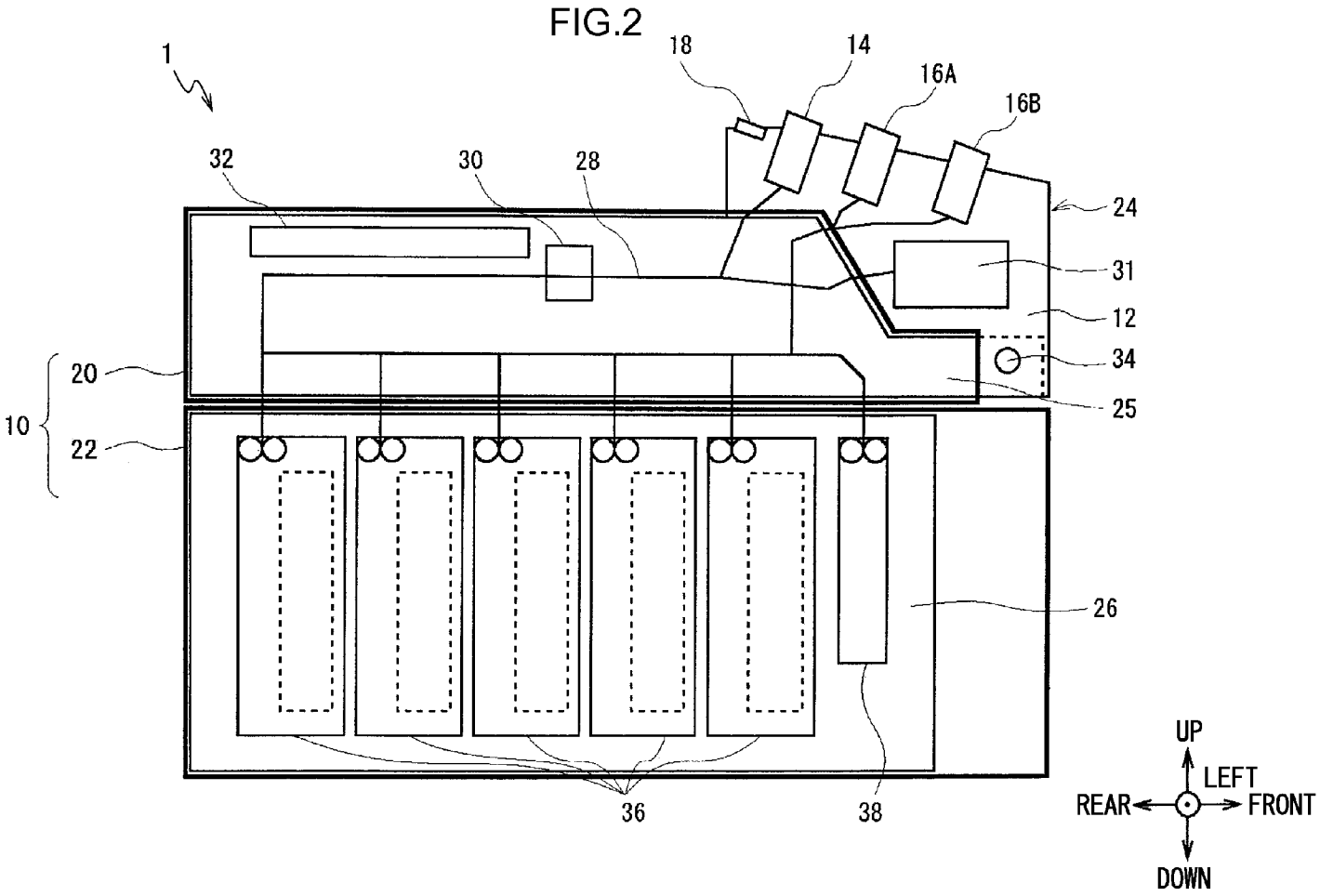
FIG. 2 is a left side view illustrating a configuration (1) of an automatic teller machine according to a first exemplary embodiment.

1. First Exemplary Embodiment 1-1. Overall Configuration of Automatic Teller Machine As illustrated in FIG. 1 and FIG. 2, an automatic teller machine 1 is bank worker operated terminal operated by a bank worker in a financial institution (for example, a service counter cashier), and performs pay-in and pay-out processing of banknotes based on operation by the bank worker.

In the automatic teller machine 1, a diagonally inclined front panel 12 is provided at a location in the upper side of a box shaped casing 10 enabling easy insertion of banknotes, and enabling easy operation of a touch panel, namely at a portion spanning from a front face upper portion to a top face. A customer interface 13 is provided to the front panel 12.

The customer interface 13A is provided with a pay-in port 14, a pay-out port 16 (16A and 16B), and a display and operation section 18. The customer interface 13 directly handles cash exchange with a user, notifies information related to transactions, and receives operation instructions.

The automatic teller machine 1 is installed such that a rear portion of the casing 10 fits under a customer service counter provided in the financial institution. The casing 10 is configured from a box shaped upper casing 20 that is positioned at an upper side and has an open front face, and a strong, box shaped lower casing 22 that is positioned at a lower side.

The automatic teller machine 1 is provided with an upper unit 24 surrounded by the upper casing 20 at the upper side, and a lower unit 26 surrounded by the lower casing 22 at the lower side.

The upper unit 24 is configured with an upper drawer 25 in which a conveyance path 28, a classification section 30, a temporary holding section 31, a controller 32, and the like are disposed, and the front panel 12 in which the pay-in port 14, the pay-out port 16, the display and operation section 18 and the like are disposed.

When pay-in banknotes are inserted by a bank worker, the pay-in bank notes are separated one note at a time and taken into the automatic teller machine 1 by the pay-in port 14.

The pay-out port 16 collects pay-out banknotes by denomination or the like, such that they can be taken out by a bank worker. Moreover, the pay-out port 16 is provided with a shutter that opens and closes the pay-out port 16, and opens when banknotes are dispensed.

The display and operation section 18 is configured by a combination of a liquid crystal display and a touch panel, and displays menu screens, result screens for various processing, and the like.

The controller 32 is configured around a Central Processing Unit (CPU). The controller 32 reads and executes specific programs from read only memory (ROM), flash memory, or the like to perform various processing such as in pay-in transactions and pay-out transactions.

Inside the controller 32 is a storage section including, for example, Random Access Memory (RAM), a hard disk drive, and flash memory. The controller 32 stores various data in the storage section.

The classification section 30 uses optical devices, magnetic detection devices, or the like to classify banknotes by denomination and authenticity, and by degree of wear and the like, while internally conveying the banknotes. The classification section 30 determines whether each banknote is a normal banknote that may be transacted, or a reject banknote that may not be transacted, based on the classification results.

The temporary holding section 31 temporarily stacks banknotes taken in through the pay-in port 14 and determined to be normal banknotes by the classification section 30. After a transaction is completed, the banknotes stacked in the temporary holding section 31 are fed out from the temporary holding section 31 and are conveyed to the classification section 30, and after the denominations thereof have been identified by the classification section 30, they are conveyed to and housed in a banknote cassette 36.

The upper unit 24 is attached to the upper casing 20 through a slide rail. The slide rail is configured by a combination of a rail shaped component extending in a front-rear direction and plural rollers or the like, and allows the upper unit 24 to move smoothly along a straight line, forwards or backwards with respect to the upper casing 20.

In the automatic teller machine 1, during a transaction operation that performs transaction processing with a bank worker, each section, banknotes, and the like, inside the upper unit 24 are protected by housing the upper unit 24 in a housing position inside the upper casing 20 as illustrated in FIG. 2. This is referred to as an upper unit housed state hereafter.

Figure 3:
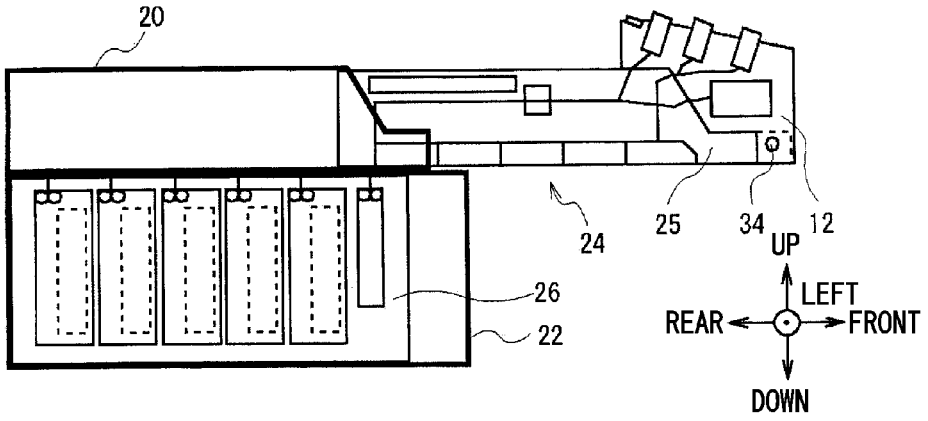
FIG. 3 is a left side view illustrating a front panel closed state in an upper unit pulled out state.
Figure 4:
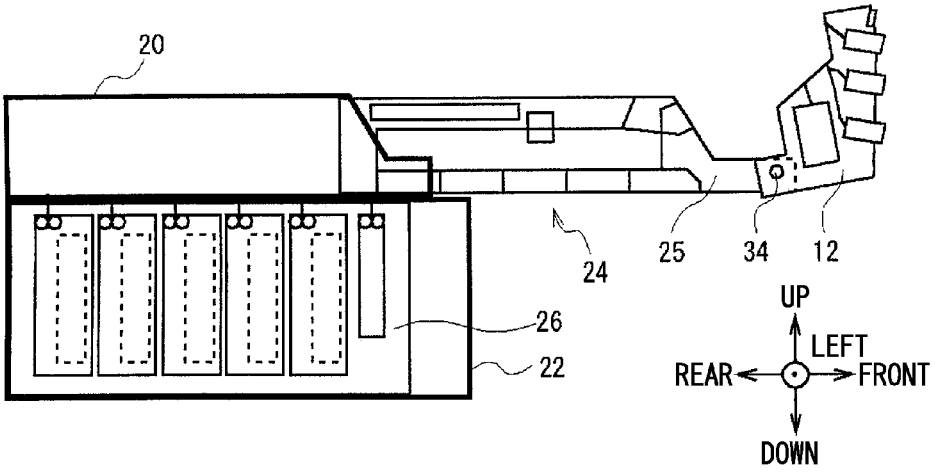
FIG. 4 is a left side view illustrating a front panel open state (1) in an upper unit pulled out state.

However, when a maintenance operation to maintain the upper unit 24 is being performed in the automatic teller machine 1 by a maintenance worker, a representative of the financial institution, or the like, the upper unit 24 is moved in the forward direction as illustrated in FIG. 3, giving a state in which substantially all of the upper unit 24 is pulled out to the exterior of the upper casing 20.

Hereafter, states in which the upper unit 24 is pulled to the front side from the housed position are referred to as an upper unit pulled out state, irrespective of whether or not substantially all of the upper unit 24 is pulled out from the upper casing 20.

The front panel 12 is configured capable of swinging about a pivot shaft 34 provided to the upper unit 24, and the front panel 12 exposes or hides the interior of the upper unit 24 from the exterior. The front panel 12 is closed so as to protect banknotes housed in the automatic teller machine 1 by covering the opening of the upper casing 20 during transaction operations. This is referred to as a front panel closed state hereafter.

Figure 14:
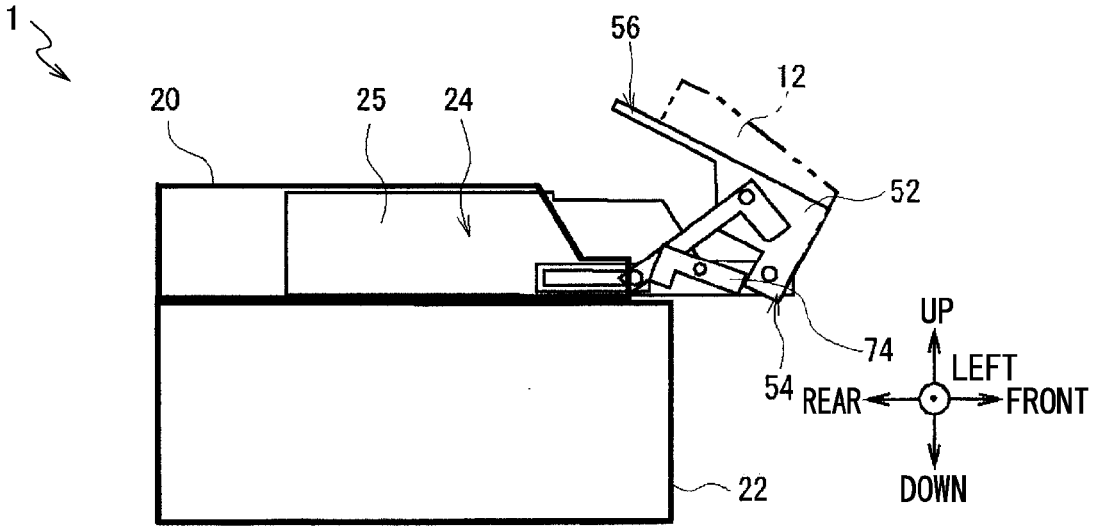
FIG. 14 is a left side view illustrating an opening operation of a front panel in a front panel state capable of swinging.

However, the front panel 12 enables operations on each section inside the upper unit 24 to be easily performed by opening in the upper unit pulled out state as illustrated in FIG. 14 during maintenance operations on the upper unit 24. Hereafter, this is referred to a front panel open state.

As illustrated in FIG. 2, the lower unit 26 is box shaped, and plural banknote cassettes 36, a reject cassette 38, and the like are incorporated therein.

The banknote cassettes 36 are arranged along the front-rear direction by respective banknote denomination, and each includes a long upright interior space capable of storing banknotes by denomination. The banknote cassettes 36 internally stack banknotes conveyed by the conveyance path 28 one on top of another in an up-down direction.

In addition to storing banknotes, the banknote cassettes 36 can also feed out internally stacked banknotes to the conveyance path 28 one note at a time.

When a banknote paid in by a bank worker or a banknote dispensed from the banknote cassette 36 is determined as a reject banknote by the classification section 30, the banknote is stacked in the reject cassette 38.

The lower unit 26 is attached to the lower casing 22 through the slide rail. The slide rail is configured by a combination of a rail-shaped component extending in the front-rear direction and plural rollers or the like, and allows the lower unit 26 to move smoothly in a straight line, forwards or backwards with respect to the lower casing 22.

A side face of a front face side of the lower casing 22 is provided with a front face door that is openable and closable. The front face door is closed during transaction operations, such that the lower casing 22 protects banknotes housed in the automatic teller machine 1. The front face door is opened as necessary during maintenance operations of the lower unit 26, such that the lower casing 22 enables maintenance to be performed easily on each internal section.

During transaction operations, the automatic teller machine 1 protects each section, banknotes, and the like inside the lower unit 26 by housing the lower unit 26 at a housing position inside the lower casing 22 as illustrated in FIG. 2. This is referred to as a lower unit housed state hereafter.

Figure 5:
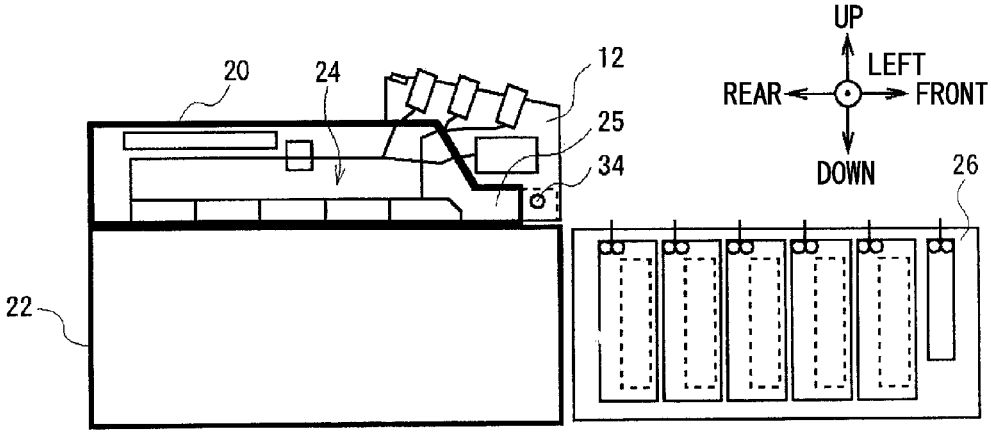
FIG. 5 is a left side view illustrating a lower unit pulled out state.

When a maintenance operation or a banknote refilling operation of the lower unit 26 is being performed in the automatic teller machine 1, the lower unit 26 is moved in the forward direction as illustrated in FIG. 5 to give a state in which substantially all of the lower unit 26 is pulled out to the exterior of the lower casing 22.

Hereafter, states in which the lower unit 26 has been pulled out from the housed position toward the front side are referred to as a lower unit pulled out state, irrespective of whether or not substantially all of the lower unit 26 has been pulled out from the lower casing 22.

In the thus configured automatic teller machine 1, the controller 32 controls each section based on banknote classification results by the classification section 30 and the like to perform banknote pay-in processing and pay-out processing.

Namely, during pay-in transactions in the automatic teller machine 1, pay-in transaction is selected by a bank worker using the display and operation section 18, and when banknotes are then inserted into the pay-in port 14, the inserted banknotes are then conveyed to the classification section 30 one note at a time.

In the automatic teller machine 1, banknotes determined as normal banknotes by the classification section 30 are conveyed to the temporary holding section 31 and temporarily housed. However, in the automatic teller machine 1, banknotes determined as pay-in reject banknotes not suitable for paying in are returned to the pay-out port 16, and returned to the bank worker by opening the shutter.

The pay-in amount is then confirmed by the bank worker, and the automatic teller machine 1 conveys banknotes housed in the temporary holding section 31 to the classification section 30, classifies the banknotes by denomination, and then conveys the banknotes to the respective banknote cassettes 36 to be held according to their value.

During pay-out transactions in the automatic teller machine 1, when pay-out transition is selected and a pay-out amount is input by the bank worker using the display and operation section 18, the number of required banknotes of each denomination is established according to the requested amount, and banknotes are fed out from each banknote cassette 36 according to the number of banknotes of each denomination and conveyed to the classification section 30.

The automatic teller machine 1 conveys banknotes determined as normal banknotes by the classification section 30 to the pay-out port 16, and conveys banknotes determined as pay-out reject banknotes not suitable for pay-out to the temporary holding section 31 to be temporarily housed.

The automatic teller machine 1 then opens the shutter when banknotes of the requested amount have been collected in the pay-out port 16. This gives a state in which banknotes collected in the pay-out port 16 can be taken, and the bank worker takes the banknotes.

The automatic teller machine 1 then conveys the pay-out reject banknotes housed in the temporary holding section 31 to the reject cassette 38 to be held.

The automatic teller machine 1 thereby performs banknote pay-in processing and pay-out processing.

1-2. Configuration of Front Panel Swinging Mechanism

Figure 6:
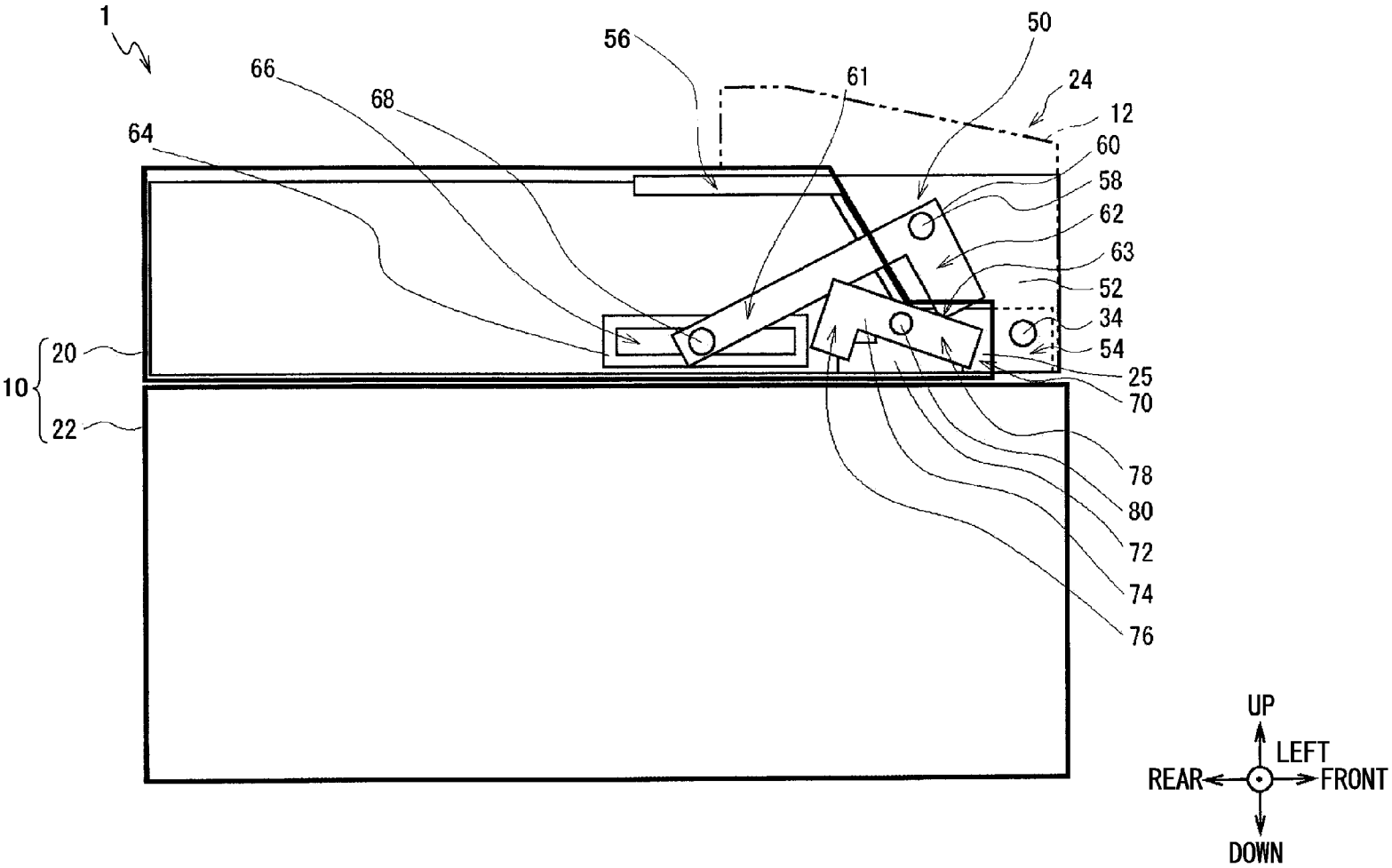
FIG. 6 is a left side view illustrating a configuration (2) of an automatic teller machine according to the first exemplary embodiment.

As illustrated in FIG. 6, the front panel 12 is configured capable of swinging with respect to the upper drawer 25 by a front panel swinging mechanism 50 configured from a front panel frame 52, a stay 60, a stay bracket 64, the pivot shaft 34, and the like The front panel frame 52 is attached to the inside of the front panel 12, and is a metal plate that supports the front panel 12. In FIG. 6, the front panel 12 is indicated by a two-short dashed, one-long dashed line, and a left side plate of the upper casing 20 is illustrated transparent.

The front panel frame 52 is attached so as to be capable of swinging with respect to the upper drawer 25 about the pivot shaft 34 that is inserted through a front end lower end portion of the front panel frame 52 and a front end lower end portion of the upper drawer 25 along the left-right direction.

To maintain the strength of a portion of the front panel frame 52 in the vicinity of the pivot shaft 34, the pivot shaft 34 is not inserted through the immediate vicinity of an end face of the front end lower end portion of the front panel frame 52. Namely, a projection 54 with a specific surface area as viewed from the side is formed at a portion of the front panel frame 52 on the lower side of the pivot shaft 34.

Figure 21:
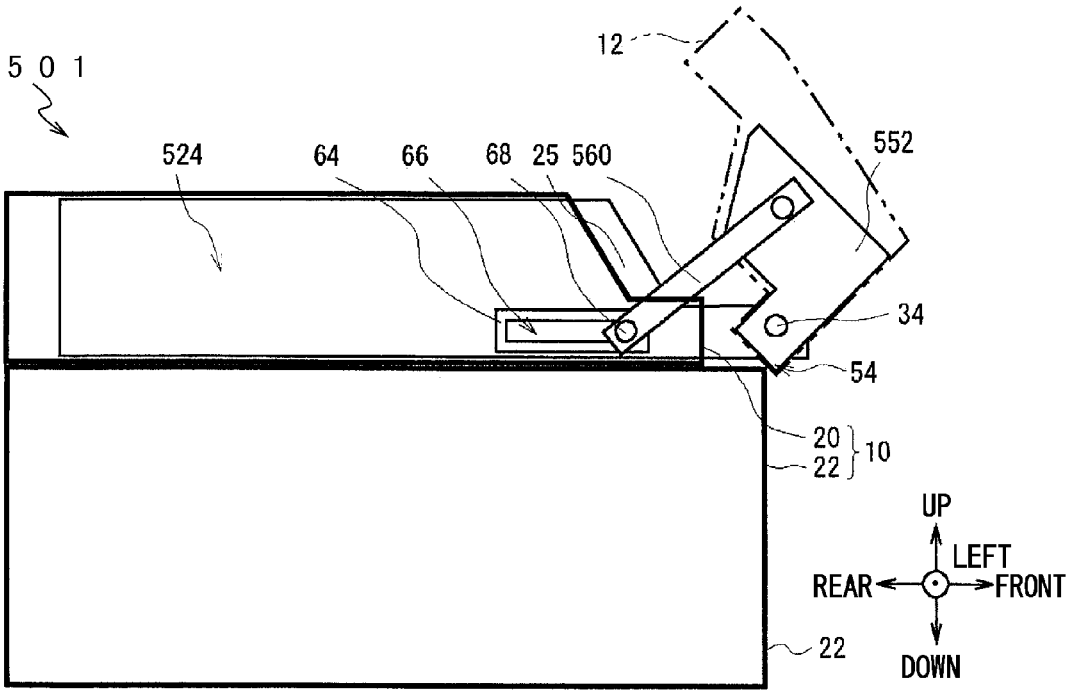
FIG.21 RELATED ART
FIG. 21 is a left side view illustrating a configuration (1) of an automatic teller machine of related art.

A front panel frame insertion portion 56 is formed at a rear end of an upper face of the front panel frame 52, and extends further toward the rear than the front panel frame 552 of the related art (FIG. 21). In the upper unit housed state, the front panel frame insertion portion 56 is inserted at the lower side of a top plate of the upper casing 20.

A circular tube shaped front panel stud 58 is provided projecting from the front panel frame 52 toward the left direction at a portion above and to the rear of the pivot shaft 34.

A front end portion of the stay 60 is attached to the front panel stud 58. The stay 60 is provided so as to be capable of swinging clockwise or anticlockwise in FIG. 6 about the front panel stud 58.

As viewed from the side, the stay 60 is an L-shaped metal plate, and the stay 60 is formed with a supporting portion 61 extending substantially along the front-rear direction, and a restriction releasing portion 62 that bends downward from a front end of the supporting portion 61. A contacting portion 63 with a curved end face is formed at a rear side of a lower end of the restriction releasing portion 62. A circular tube shaped stay shoulder stud 68 is provided projecting in the right direction from a rear end portion of the stay 60.

The stay bracket 64 is a metal plate that extends in the front-rear direction and is attached to a left side plate of the upper drawer 25. A stay bracket groove 66 provided extending along the front-rear direction pierces the stay bracket 64 in the left-right direction such that the stay shoulder stud 68 fits into the stay bracket groove 66.

The stay shoulder stud 68 slides along the stay bracket groove 66 in the front-rear direction while fitted into the stay bracket groove 66 of the stay bracket 64.

The stay 60 thereby moves by sliding along the stay bracket groove 66 of the stay bracket 64 in the front-rear direction while swinging about the front panel stud 58.

Figure 7:
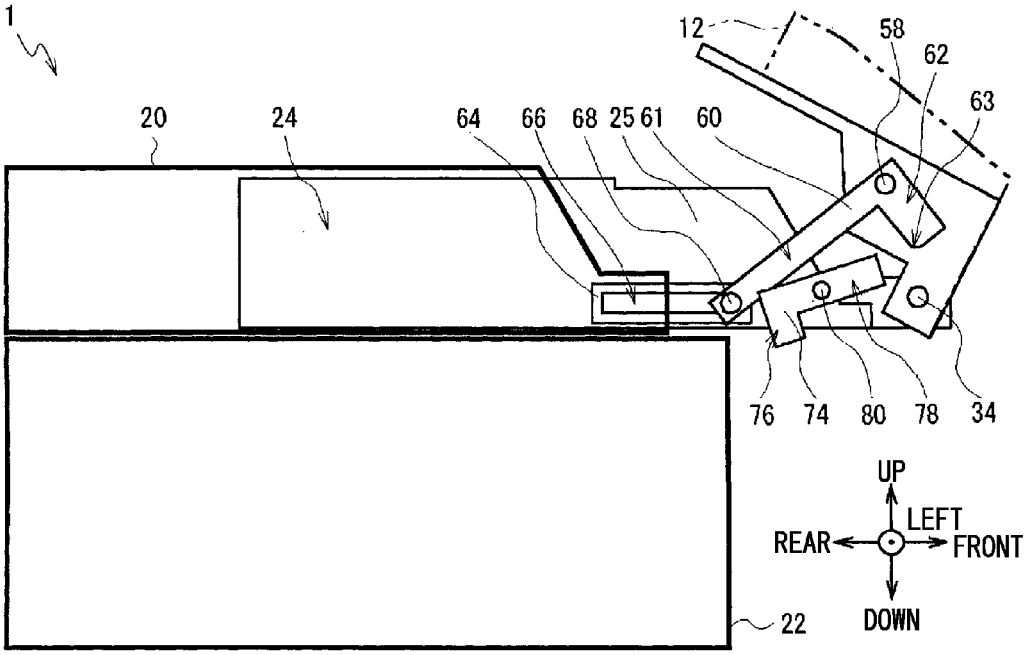
FIG. 7 is a left side view illustrating a front panel open state (2) in an upper unit pulled out state.
Figure 8:
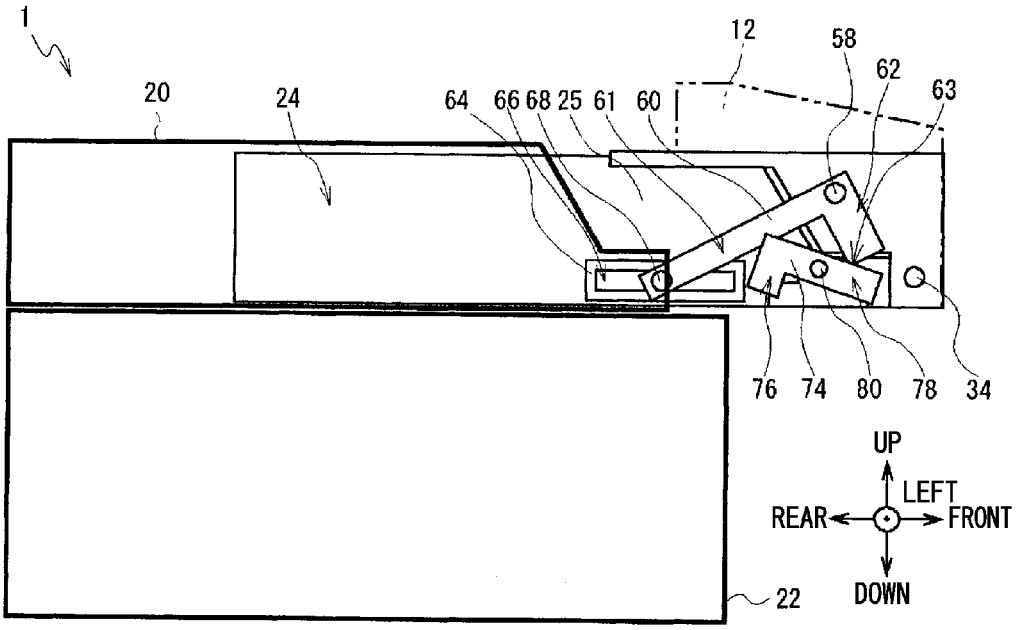
FIG. 8 is left side view illustrating a front panel closed state (2) in an upper unit pulled out state.

The stay 60 adopts a somewhat upright orientation when in the front panel open state illustrated in FIG. 7, and, when in the front panel closed state illustrated in FIG. 8, adopts a more reclining orientation than in the front panel open state. The contacting portion 63 of the restriction releasing portion 62 is positioned lower when in the front panel closed state than when in the front panel open state.

1-3. Configuration of Front Panel Collision Prevention Mechanism

As illustrated in FIG. 6, a front panel collision prevention mechanism 70 that prevents the projection 54 of the front panel 12 from colliding with the lower casing 22 is provided to a front portion of the left side plate of the upper drawer 25. The front panel collision prevention mechanism 70 is configured from the front panel swinging mechanism 50, a knock bracket 72, a knock lever 74, and a knock shaft 80.

The plate-shaped metal knock bracket 72 is fixed to the front portion of the left side plate of the upper drawer 25, and a hole pierces through the knock bracket 72 in the left-right direction.

The knock lever 74 is disposed at a lower side of the restriction releasing portion 62 of the stay 60 at the left side of the knock bracket 72. The circular tube shaped knock shaft 80 is provided projecting in the right direction from substantially the front-rear direction center of the of the knock lever 74, and is fitted into the hole in the knock bracket 72. The knock lever 74 is thereby attached so as to be able to turn about the knock shaft 80 with respect to the knock bracket 72.

The knock lever 74 is biased in the anticlockwise direction in the drawings (also referred to as the restriction direction hereafter) by a spring, and a stopper is provided such that the knock lever 74 does not turn beyond a specific turn position in the anticlockwise direction.

As viewed from the side, the knock lever 74 is an L-shaped metal plate, and is formed with a transfer portion 78 that extends substantially along the front-rear direction, and a restriction portion 76 that bends downward from a rear end of the transfer portion 78.

In the front panel closed state illustrated in FIG. 8, the stay shoulder stud 68 is positioned at a portion at substantially the center of the stay bracket groove 66, and the stay 60 has assumed a more reclined state.

In this state, the restriction releasing portion 62 of the stay 60 pushes the vicinity of a front end of the transfer portion 78 of the knock lever 74 downward from above, and the knock lever 74 accordingly turns further clockwise (also referred to as a retraction direction hereafter) against the anticlockwise biasing force than when in the front panel open state. A lower end portion of the restriction portion 76 of the knock lever 74 is thereby positioned further to the upper side than an upper end portion of the front face of the lower casing 22. This state is also referred to as a knock lever retracted state hereafter.

However, in the front panel open state illustrated in FIG. 7, the stay 60 adopts a state of being further upright than in the front panel closed state, and the stay shoulder stud 68 makes contact with the front end of the stay bracket groove 66. The front panel 12 is thereby restricted from swinging clockwise, and the position thereof is retained.

In this state, the restriction releasing portion 62 of the stay 60 is separated above the transfer portion 78 of the knock lever 74. The knock lever 74 therefore turns further in the anticlockwise direction than in the front panel closed state due to the anticlockwise biasing force. The lower end portion of the restriction portion 76 of the knock lever 74 is thereby positioned further to the lower side than the upper end portion of the front face of the lower casing 22. This state is also referred to as a knock lever restriction state hereafter.

At this time, a rear end face of the restriction portion 76 of the knock lever 74 inclines from the lower side toward the upper side on progression from the front toward the rear.

1-4. Upper Unit Pushing in Operation

Figure 9:
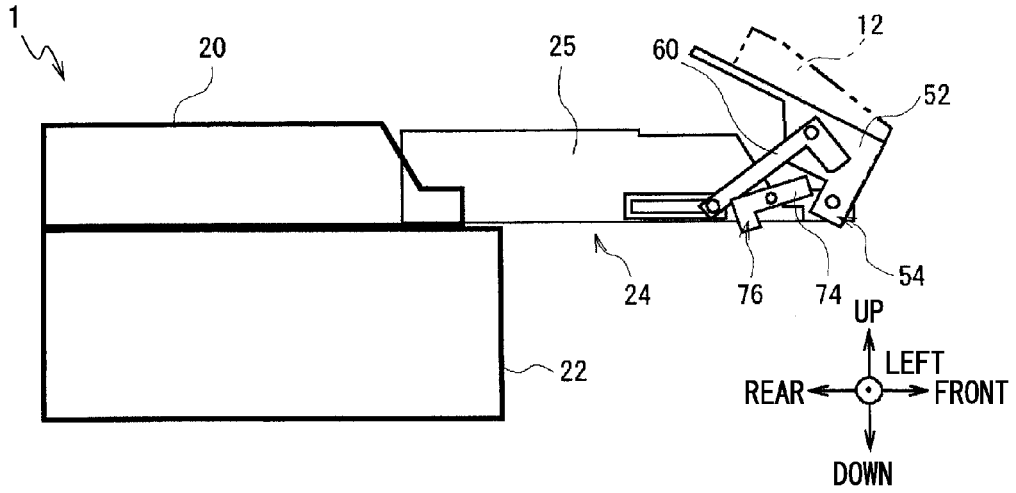
FIG. 9 is a left side view illustrating a front panel open state (3) in an upper unit pulled out state.

In such a configuration, in the front panel open state when in the upper unit pulled out state illustrated in FIG. 9, the projection 54 of the front panel 12 is positioned further toward the lower side than the upper end portion of the front face of the lower casing 22, and the restriction portion 76 of the knock lever 74 is also positioned further toward the lower side than the upper end portion of the lower casing 22, configuring the knock lever restriction state.

Figure 10:
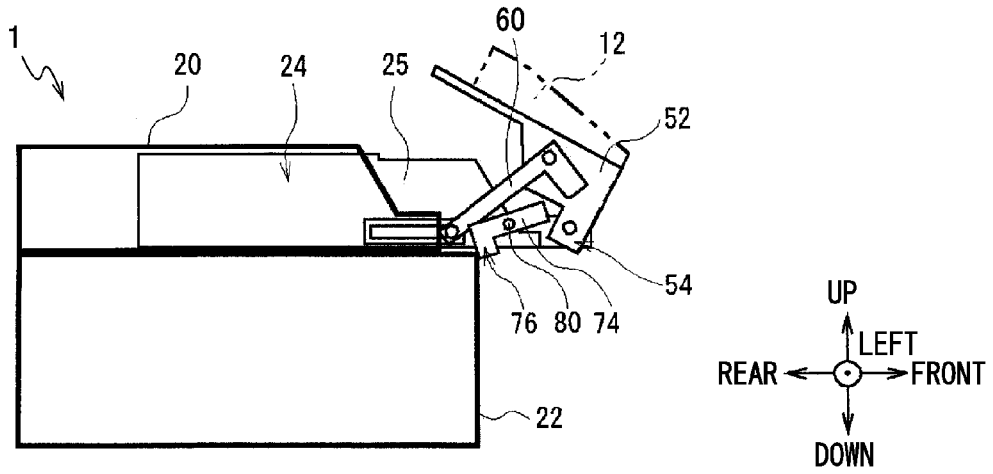
FIG. 10 is a left side view illustrating a knock lever collision state.

When the upper unit 24 is pushed into the upper casing 20 in while still in the front panel open state, as illustrated in FIG. 10, the restriction portion 76 of the knock lever 74 strikes the upper end portion of the front face of the lower casing 22. Therefore, the projection 54 of the front panel 12 does not collide with the lower casing 22.

If the knock lever 74 was to turn clockwise when the knock lever 74 collides with the lower casing 22, there would be a possibility of the lower end portion of the restriction portion 76 of the knock lever 74 retracting further toward the upper side than the upper end portion of the front face of the lower casing 22. In such cases, the projection 54 of the front panel 12 would collide with the lower casing 22 without the restriction portion 76 of the knock lever 74 colliding with the lower casing 22.

In contrast thereto, in the automatic teller machine 1 according to the present exemplary embodiment, as described above, the rear end face of the restriction portion 76 of the knock lever 74 is inclined from the lower side toward the upper side on progression from the front to the rear, and below the knock shaft 80, force from the rear to the front is applied to the restriction portion 76 from the lower casing 22.

Therefore, the lower end portion of the restriction portion 76 of the knock lever 74 can be prevented from retracting further to the upper side than the upper end portion of the front face of the lower casing 22 by applying a force to turn the knock lever 74 anticlockwise. Since the stopper is provided to the knock lever 74 as described above, turning is restricted due to hitting the stopper when the knock lever 74 turns to the specific angle or beyond in the restriction direction.

Figure 11:
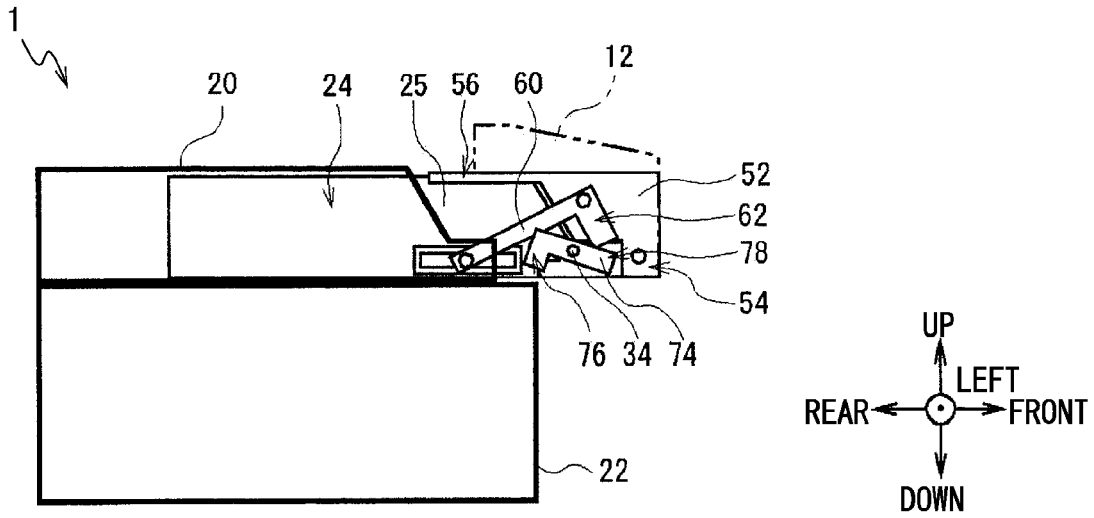
FIG. 11 is a left side view illustrating a front panel closed state (2) in an upper unit pulled out state.

When the user swings the front panel 12 anticlockwise (in a closing direction) from this state and thereby closes the front panel 12, the stay 60 swings in the clockwise direction while moving toward the rear, and the front panel 12 closes, configuring the front panel closed state illustrated in FIG. 11. The projection 54 of the front panel 12 is thereby positioned above the upper end of the lower casing 22.

At this time, the restriction releasing portion 62 of the stay 60 pushes the vicinity of the front end portion of the transfer portion 78 of the knock lever 74 downward from above, thereby turning the knock lever 74 in the retraction direction to configure the knock lever retracted state.

Figure 12:
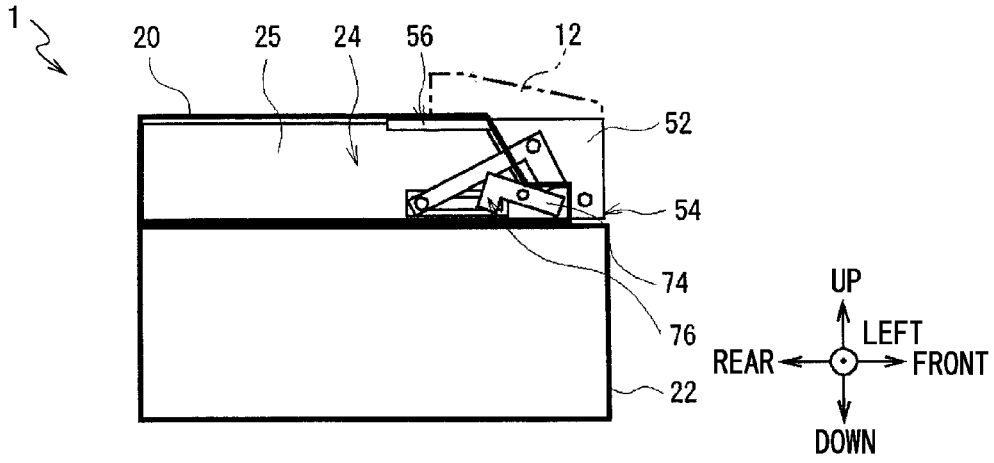
FIG. 12 is a left side view illustrating an upper unit housed state.

When the upper unit 24 is pushed into the upper casing 20 from this state, the upper unit 24 moves toward the rear without the restriction portion 76 of the knock lever 74 or the projection 54 of the front panel 12 contacting the lower casing 22, and the front panel frame insertion portion 56 is inserted at the lower side of the top plate of the upper casing 20, configuring the upper unit housed state illustrated in FIG. 12.

1-5. Front Panel Opening Operation

Figure 22:
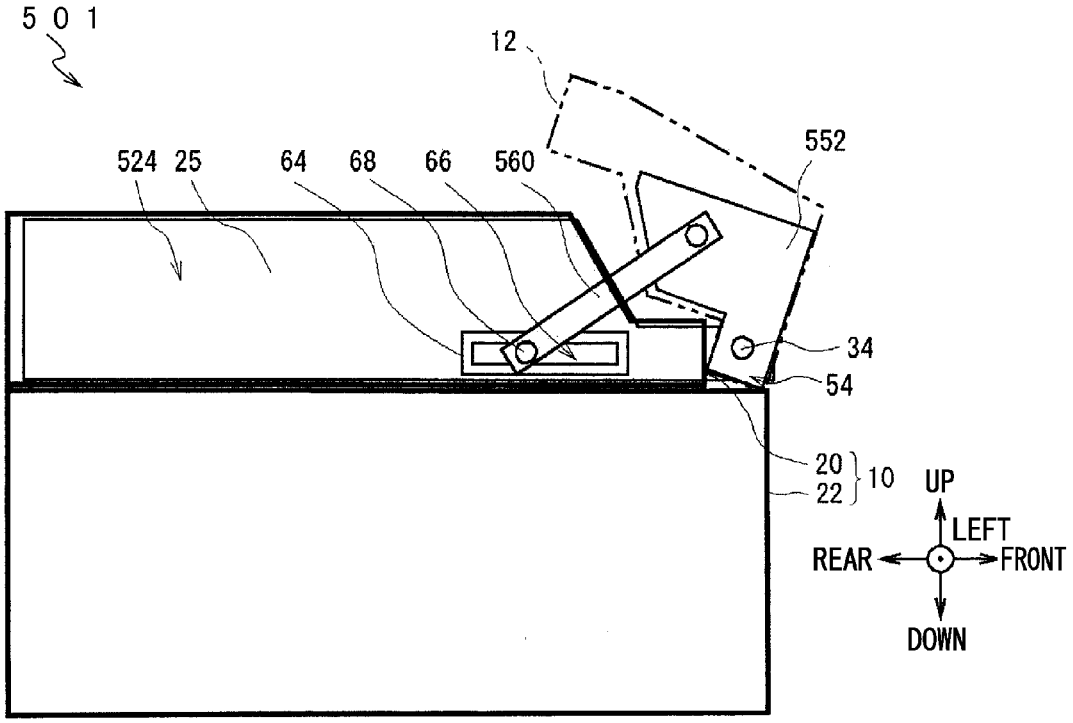
FIG.22 RELATED ART
FIG. 22 is a left side view illustrating a configuration (2) of an automatic teller machine of related art.

As mentioned, in the automatic teller machine 501 of the related art, the front panel frame 552 is not inserted at the lower side of the top plate of the upper casing 20 in the upper unit housed state. Therefore, as illustrated in FIG. 22, there is an issue that the projection 54 of the front panel 12 may contact the lower casing 22, resulting in damage, when the user attempts to open the front panel 12 with the upper unit 24 in a state pulled out slightly forward while still in the upper unit housed state.

In contrast thereto, in the automatic teller machine 1 according to the present exemplary embodiment, the user cannot open the front panel 12 in the upper unit housed state since the front panel frame insertion portion 56 is inserted at the lower side of the top plate of the upper casing 20.

The automatic teller machine 1 thereby prevents the projection 54 of the front panel 12 from contacting the lower casing 22 in the upper unit housed state, and can prevent damage.

Figure 13:
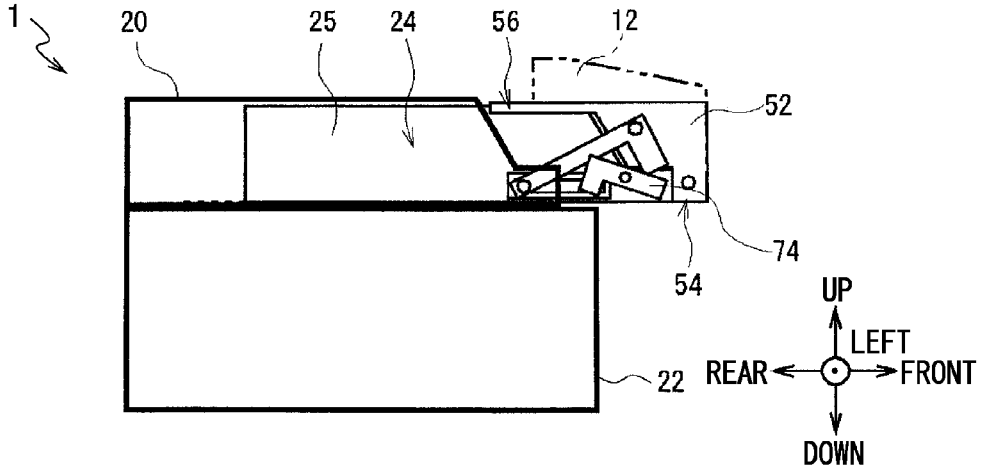
FIG. 13 is a left side view illustrating a front panel state capable of swinging.

In order to open the front panel 12 from the upper unit housed state, the user pulls the upper unit 24 forward from the upper casing 20 as illustrated in FIG. 13.

The front panel frame insertion portion 56 accordingly separates to the front side from the lower side of the top plate of the upper casing 20, configuring a front panel state capable of swinging in which swinging of the front panel 12 in the opening direction is no longer restricted by the upper casing 20.

In this state the user swings the front panel 12 clockwise (in the opening direction) to open the front panel 12. As illustrated in FIG. 14, when doing so the front panel 12 opens without the projection 54 contacting the lower casing 22 since the projection 54 of the front panel 12 is separated from the front face of the lower casing, thus configuring the front panel open state.

Configuration of the automatic teller machine 1 can thereby be made such that the projection 54 of the front panel 12 does not contact the lower casing 22, by housing the front panel frame insertion portion 56 at the lower side of the top plate of the upper casing 20 and restricting swinging of the front panel 12 in the upper unit housed state.

The front panel frame insertion portion 56 and the top plate of the upper casing 20 vertically overlap by an amount such that the front panel frame insertion portion 56 separates from the top plate of the upper casing 20 when the front panel 12 has been pulled out to a front panel swingable position at which the projection 54 does not contact the lower casing 22 when the front panel 12 is swung in the opening direction.

1-6. Advantageous Effects

When the upper unit 24 is pushed into the upper casing 20 in the front panel open state in automatic teller machine 1 configured as described above, the restriction portion 76 of the knock lever 74 is positioned further to the lower side than the upper end portion of the lower casing 22, and makes contact with the lower casing 22 before the projection 54 of the front panel 12.

The front panel open state in automatic teller machine 1 accordingly enables interference between the front panel 12 and the lower casing 22 to be prevented, and enables damage to the front panel 12 to be avoided.

When the upper unit 24 is pushed into the upper casing 20 in the front panel closed state in the automatic teller machine 1, the restriction portion 76 of the knock lever 74 is positioned more toward the upper side than both the projection 54 of the front panel 12 and the lower casing 22.

Thus, in the automatic teller machine 1, the upper unit 24 can be housed in the upper casing 20 in the front panel closed state in which the projection 54 of the front panel 12 does not contact the lower casing 22.

If the pivot shaft 34 were provided to an upper portion of the upper unit 24, the user would lift the front panel up from below in order to open closing the front panel.

In such cases, there is a possibility of the front panel contacting the user if the front panel were to suddenly shut, since the front panel and the front panel frame have a heavy configuration. Moreover, opening by lifting up the heavy front panel increases the burden on the user.

Thus, in the automatic teller machine 1 according to the present exemplary embodiment, the pivot shaft 34 is inserted through the front end lower end portion of the front panel frame 52 and the front end portion of the upper unit 24, and the front panel 12 is opened about the pivot shaft 34 by pulling the front panel 12 forward toward the user.

However, in such a configuration, the projection 54 positioned below the pivot shaft 34 is positioned below the upper end portion of the lower casing 22, presenting an issue of the projection 54 colliding with the lower casing 22 when the upper unit 24 is pushed into the upper casing 20 while still in the front panel open state.

In contrast thereto, in the automatic teller machine 1 according to the present exemplary embodiment, the knock lever 74 is made to contact the lower casing 22 when the upper unit 24 is pushed into the upper casing 20 in the front panel open state.

The automatic teller machine 1 thereby enables damage to the front panel 12 to be prevented in the automatic teller machine 1 that is placed in the front panel open state by swinging to the front about a front end portion lower portion of the upper unit 24.

Moreover, in the automatic teller machine 1, switching between the knock lever restriction state and the knock lever retracted state is achieved by swinging the front panel 12 in the opening direction with respect to the upper drawer 25, and turning the knock lever 74 coupled to the stay 60 that supports the open state.

Thus, in the automatic teller machine 1, the knock lever 74 can be moved using the operation of the stay 60 originally provided in order to support opening and closing of the front panel 12, and damage to the front panel 12 can be prevented by a simple configuration.

Moreover, in the automatic teller machine 1, in the upper unit housed state, swinging of the front panel 12 in the opening direction is restricted by inserting the front panel frame insertion portion 56 at the lower side of the top plate of the upper casing 20.

Thus, in the automatic teller machine 1, damage caused by the projection 54 of the front panel 12 contacting the lower casing 22 can be prevented when the user attempts to open the front panel 12 in the upper unit housed state.

The automatic teller machine 1 according to the above configuration includes the upper casing 20 including a specific interior space, the lower casing 22 that is disposed below the upper casing 20 and that internally stores the medium cassettes 36 that house the banknotes, the upper unit 24 that adopts the pulled out state by being pulled out forward from the housed state of being housed in the upper casing 20, the customer interface 13 that is provided to the upper unit 24 and that receives transactions related to the banknotes, the front panel 12 on the front face of the upper unit 24 that adopts the open state in which the interior of the upper unit 24 is open to the outside by swinging in the opening direction, and adopts the closed state in which the interior of the upper unit 24 is closed off from the outside by swinging in the closing direction, and the front panel collision prevention mechanism 70 that restricts movement of the upper unit 24 toward the upper casing 20 when the upper unit 24 is moved toward the upper casing 20 with the front panel 12 still in the open state.

2. Second Exemplary Embodiment

Figure 15:
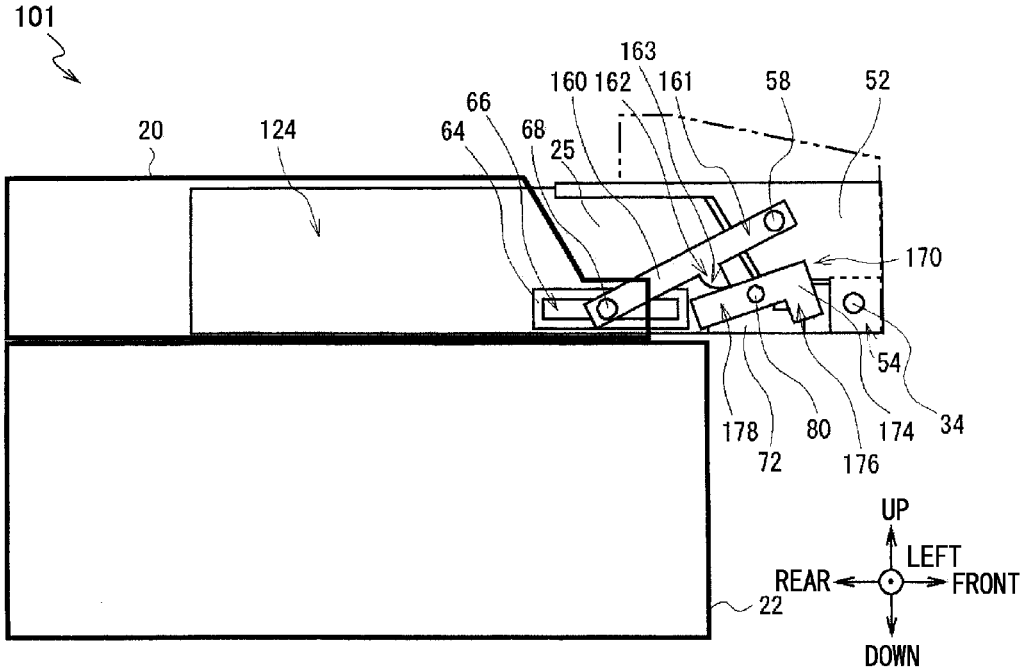
FIG. 15 is a left side view illustrating a configuration (1) of an automatic teller machine according to a second exemplary embodiment.

An automatic teller machine 101 according to a second exemplary embodiment illustrated in FIG. 1 differs from the automatic teller machine 1 according to the first exemplary embodiment in that a front panel collision prevention mechanism 170 of an upper unit 124 illustrated in FIG. 15 is different from the front panel collision prevention mechanism 70 of the upper unit 24; however, the automatic teller machine 101 is otherwise configured similarly.

As viewed from the side, a knock lever 174 is an L-shaped metal plate, and is formed with a transfer portion 178 that extends substantially along the front-rear direction, and a restriction portion 176 that bends downward from a front end of the transfer portion 178.

The knock lever 174 is biased in the clockwise direction in the drawings by a spring, and a stopper is provided such that the knock lever 174 does not turn beyond a specific turn position in the clockwise direction.

As viewed from the side, a stay 160 is a T-shaped metal plate, and is formed with a supporting portion 161 extending substantially along the front-rear direction, and a restriction releasing portion 62 that projects downward from a portion at substantially the center of the supporting portion 61 in the front-rear direction. A contacting portion 163 with a curved end face is formed to a rear side of a lower end of the restriction releasing portion 162.

In the front panel closed state illustrated in FIG. 15, the restriction releasing portion 162 of the stay 160 pushes the vicinity of a rear end of the transfer portion 178 of the knock lever 174 downward from above, and the knock lever 174 accordingly turns anticlockwise against the clockwise biasing force. A lower end portion of the restriction portion 176 of the knock lever 174 is thereby positioned further to the upper side than an upper end portion of the front face of the lower casing 22, configuring the knock lever retracted state.

Figure 16:
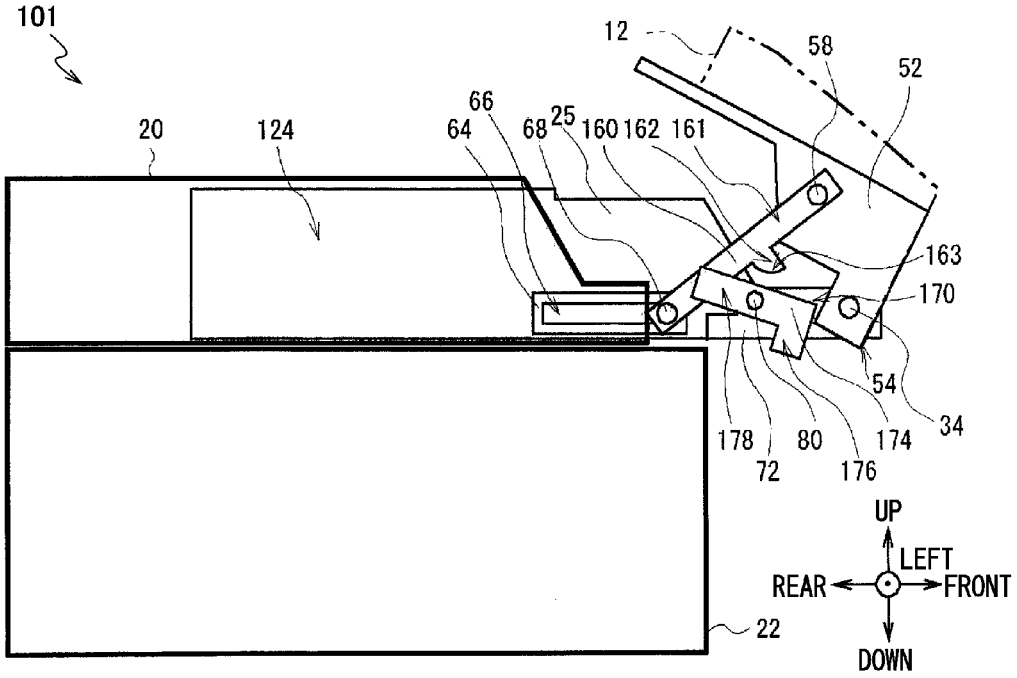
FIG. 16 is a left side view illustrating a configuration (2) of an automatic teller machine according to the second exemplary embodiment.

However, in the front panel open state illustrated in FIG. 16, the stay 160 adopts a state of being further upright than in the front panel closed state and the restriction releasing portion 162 is separated above the transfer portion 178 of the knock lever 174, causing the clockwise biasing force to turn the knock lever 174 further in the clockwise direction than in the front panel closed state. A lower end portion of the restriction portion 176 of the knock lever 174 is thereby positioned further to the lower side than the upper end portion of the front face of the lower casing 22, configuring the knock lever restriction state.

In this manner, in the automatic teller machine 101, the restriction releasing portion 162 that projects from the substantially center portion of the supporting portion 161 of the stay 160 in the front-rear direction contacts or separates from the vicinity of the rear end of the transfer portion 178 of the knock lever 174, thus turning the knock lever 174 and switching between the knock lever restriction state and the knock lever retracted state.

Thus, when the upper unit 124 is pushed into the upper casing 20 in the front panel open state in the automatic teller machine 101, the restriction portion 176 that bends downward from the front end of the transfer portion 178 of the knock lever 174 is caused to contact the lower casing 22 before the projection 54 of the front panel 12, thereby preventing damage to the front panel 12.

Moreover, when the upper unit 124 is pushed into the upper casing 20 in the front panel closed state in the automatic teller machine 101, the restriction portion 176 of the knock lever 174 is positioned further toward the upper side than both the projection 54 of the front panel 12 and the lower casing 22, enabling the upper unit 124 to be housed in the upper casing 20.

3. Third Exemplary Embodiment

Figure 17:
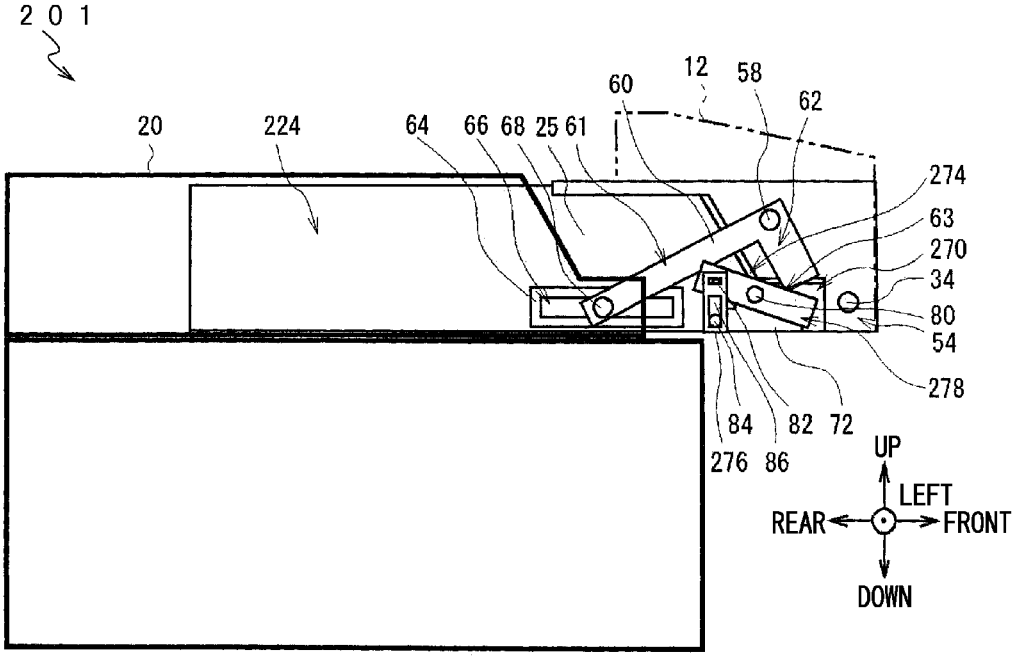
FIG. 17 is a left side view illustrating a configuration (1) of an automatic teller machine according to a third exemplary embodiment.

An automatic teller machine 201 according to a third exemplary embodiment illustrated in FIG. 1 differs from the automatic teller machine 1 according to the first exemplary embodiment in that a front panel collision prevention mechanism 270 of an upper unit 224 illustrated in FIG. 17 is different from the front panel collision prevention mechanism 70 of the upper unit 24; however, the automatic teller machine 201 is otherwise configured similarly.

A knock lever 274 is formed with a transfer portion 278 that extends substantially along the front-rear direction, and a restriction portion 276 that extends in the up-down direction, connected to a rear end of the transfer portion 278 through a knock lever stud 82.

The transfer portion 278 turns about the knock shaft 80 provided to a front-rear direction center portion of the transfer portion 278. The restriction portion 276 moves back and forth in the up-down direction due to a restriction portion groove 86 along the up-down direction piercing the restriction portion 276 sliding along the up-down direction with respect to a restriction portion stud 84 projecting from the knock bracket 72. A groove along the front-rear direction piercing the restriction portion 276 slides in the front-rear direction with respect to the knock lever stud 82.

The transfer portion 278 is biased in the anticlockwise direction in the drawings by a spring, and a stopper is provided such that the transfer portion 278 does not turn beyond a specific turn position in the anticlockwise direction.

In the front panel closed state illustrated in FIG. 17, the restriction releasing portion 62 of the stay 60 pushes the vicinity of a front end of the transfer portion 278 of the knock lever 274 downward from above, and the transfer portion 278 accordingly turns clockwise against the anticlockwise biasing force. The transfer portion 278 accordingly moves the restriction portion 276 upward using the knock lever stud 82, and a lower end portion of the restriction portion 276 is thereby positioned further to the upper side than an upper end portion of the front face of the lower casing 22, configuring the knock lever retracted state.

Figure 18:
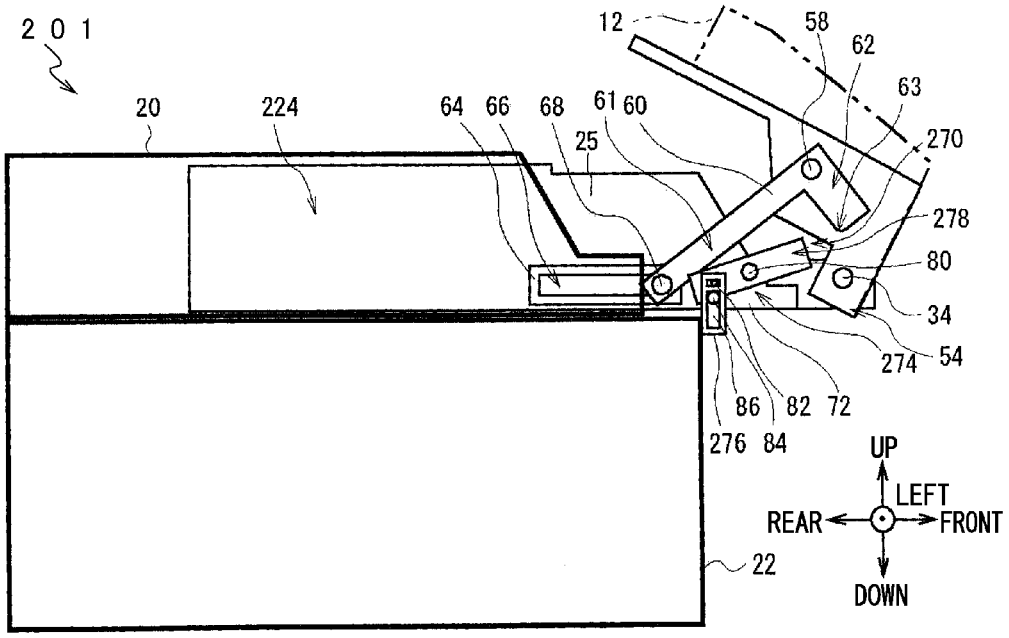
FIG. 18 is a left side view illustrating a configuration (2) of an automatic teller machine according to the third exemplary embodiment.

However, in the front panel open state illustrated in FIG. 18, the stay 60 adopts a state of being further upright than in the front panel closed state and the restriction releasing portion 62 is separated above the transfer portion 278 of the knock lever 274, causing the anticlockwise biasing force to turn the transfer portion 278 further in the anticlockwise direction than in the front panel closed state. The transfer portion 278 accordingly moves the restriction portion 276 downward using the knock lever stud 82, and a lower end portion of the restriction portion 276 of the knock lever 174 is thereby positioned further to the lower side than the upper end portion of the front face of the lower casing 22, configuring the knock lever restriction state.

In this manner, in the automatic teller machine 201, the restriction releasing portion 62 of the supporting portion 161 of the stay 60 contacts the vicinity of the front end of the transfer portion 278 of the knock lever 274, or separates from the vicinity of the front end of the transfer portion 278, thus moving the restriction portion 276 up and down using the knock lever stud 82 and switching between the knock lever restriction state and the knock lever retracted state.

Thus, when the upper unit 224 is pushed into the upper casing 20 in the front panel open state in the automatic teller machine 201, the anticlockwise turning force of the transfer portion 278 of the knock lever 274 is converted to a moving force in the downward direction, the restriction portion 276 is moved downward, and the restriction portion 276 is caused to contact the lower casing 22 before the projection 54 of the front panel 12, thereby preventing damage to the front panel 12.

Moreover, when the upper unit 224 is pushed into the upper casing 20 in the front panel closed state in the automatic teller machine 201, the clockwise turning force of the transfer portion 278 of the knock lever 274 is converted to a moving force in the upward direction, the restriction portion 276 is moved upward, and the restriction portion 276 is positioned further toward the upper side than both the projection 54 of the front panel 12 and the lower casing 22, enabling the upper unit 224 to be housed in the upper casing 20.

4. Fourth Exemplary Embodiment

Figure 19:
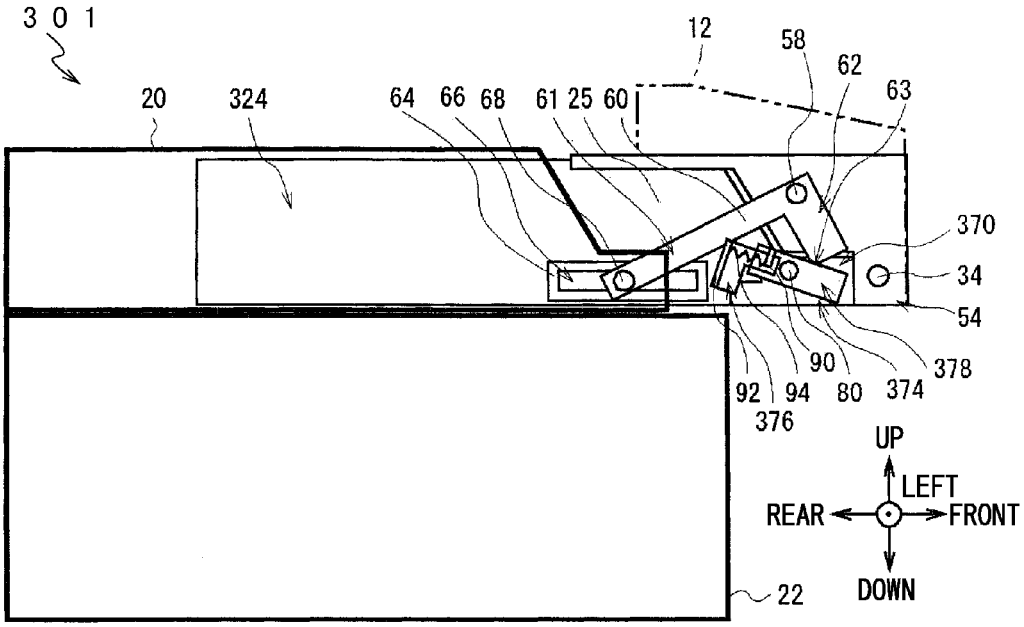
FIG. 19 is a left side view illustrating a configuration (1) of an automatic teller machine according to a fourth exemplary embodiment.

An automatic teller machine 301 according to a fourth exemplary embodiment illustrated in FIG. 1 differs from the automatic teller machine 1 according to the first exemplary embodiment in that a front panel collision prevention mechanism 370 of an upper unit 324 illustrated in FIG. 19 is different from the front panel collision prevention mechanism 70 of the upper unit 24; however, the automatic teller machine 301 is otherwise configured similarly.

A knock lever 374 is configured from a transfer portion 378 that extends substantially along the front-rear direction, and a restriction portion 376 that is L-shaped as viewed from the side, is slidably fitted inside the transfer portion 378, and has a rear end that bends downward.

A spring front end anchoring portion 90 is provided to the transfer portion 378 projecting downward from an upper side plate thereof. A plate shaped spring rear end anchoring portion 92 is provided to a rear end of the restriction portion 376 and extends in the up-down and left-right directions. A spring 94 is fitted between the spring front end anchoring portion 90 and the spring rear end anchoring portion 92, and serves as a shock absorbing member.

The transfer portion 378 is biased in the anticlockwise direction in the drawings by a spring, and a stopper is provided such that the transfer portion 378 does not turn beyond a specific turn position in the anticlockwise direction.

In the front panel closed state illustrated in FIG. 19, the restriction releasing portion 62 of the stay 60 pushes the vicinity of a front end of the transfer portion 378 of the knock lever 374 downward from above, and the transfer portion 378 accordingly turns clockwise against the anticlockwise biasing force. The restriction portion 376 accordingly turns clockwise together with the transfer portion 378, and a lower end portion of the restriction portion 376 is thereby positioned further to the upper side than an upper end portion of the front face of the lower casing 22, configuring the knock lever retracted state.

Figure 20:
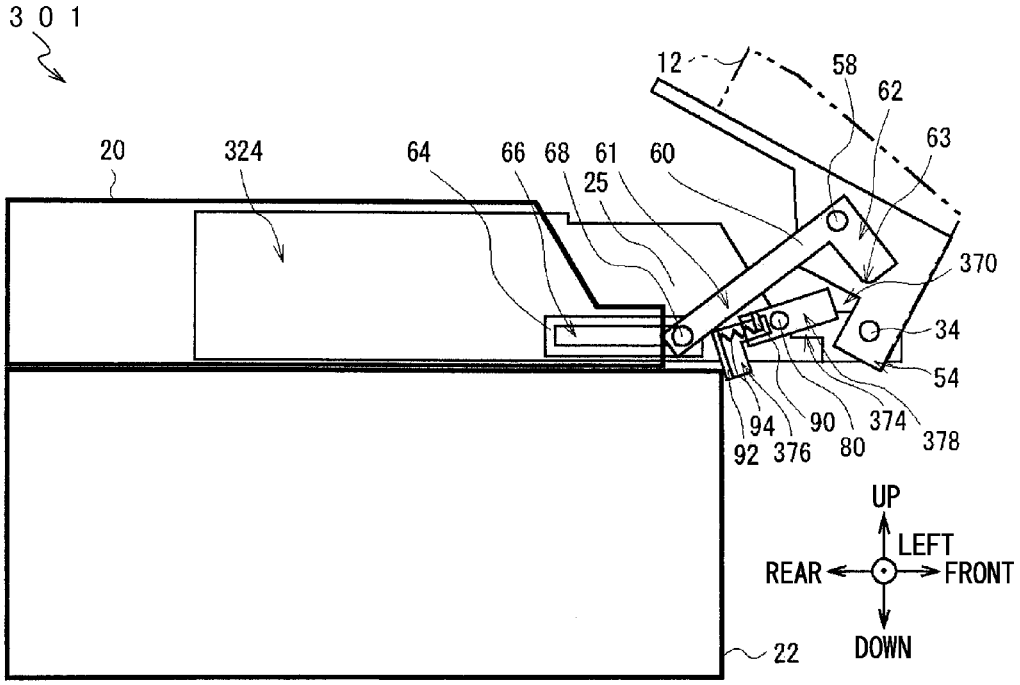
FIG. 20 is a left side view illustrating a configuration (2) of an automatic teller machine according to the fourth exemplary embodiment.

However, in the front panel open state illustrated in FIG. 20, the stay 60 adopts a state of being further upright than in the front panel closed state and the restriction releasing portion 62 is separated above the transfer portion 378 of the knock lever 374, causing the anticlockwise biasing force to turn the transfer portion 378 further in the anticlockwise direction than in the front panel closed state. The restriction portion 376 accordingly turns anticlockwise together with the transfer portion 378, and a lower end portion of the restriction portion 376 is thereby positioned further to the lower side than the upper end portion of the front face of the lower casing 22, configuring the knock lever restriction state.

When the upper unit 324 is pushed into the upper casing 20 while still in the front panel open state, the restriction portion 376 of the knock lever 374 collides with the lower casing 22 and the restriction portion 376 is restricted from moving backward. When this occurs, the spring 94 is compressed by the restriction portion 376 and the transfer portion 378, and the impact force transmitted from the restriction portion 376 to the transfer portion 378 is thereby lessened.

In the automatic teller machine 301, the spring 94 serving as a shock absorbing member is provided between the restriction portion 376 of the knock lever 374 and the transfer portion 378.

Thus, in the automatic teller machine 301, when the upper unit 324 is pushed into the upper casing 20 in the front panel open state, impact force transmitted to the upper drawer 25 and the front panel 12 through the knock lever 374 can be lessened, and damage to the automatic teller machine 301 can be further prevented.

5. Other Exemplary Embodiments

Although description has been given for cases in which a knock lever is turned by the operation of a stay in the exemplary embodiments described above, the present invention is not limited thereto. The knock lever may be caused to turn by various links, wires, and the like that operate coupled to operation of the front panel.

Although description has been given for cases in which the projection 54 of the front panel 12 is prevented from colliding with the lower casing 22 by the knock lever 74, 174, 274 and 374 contacting the lower casing 22 in the exemplary embodiments described above, the present invention is not limited thereto. The knock lever 74, 174, 274 and 374 may be caused to make contact at various locations, for example, at a metal plate provided to the upper casing 20 or provided inside the upper casing 20.

In cases in which the knock lever contacts the lower casing 22 as in the exemplary embodiments described above, the lower unit 26 cannot be pulled out from the lower casing 22 in the upper unit pulled out state with the front panel open state, even when attempting to pull out the lower unit 26 forward from the lower casing 22, since the lower unit 26 is contacted by the knock lever 74, 174, 274, and 374 from the front.

The lower unit 26 can thereby be prevented from contacting the projection 54 of the front panel 12 when pulled out from the lower casing 22 in the front panel open state.

Although description has been given for cases in which switching between the knock lever restriction state and the knock lever retracted state is achieved by turning the knock lever 74, 174, 274 and 374 in the exemplary embodiments described above, the present invention is not limited thereto. Switching between the knock lever restriction state and the knock lever retracted state may be achieved by various methods of movement, such as by sliding the knock lever.

Although description has been given for cases in which the front panel collision prevention mechanism 70, 170, 270, and 370 is only provided to the left side plate of the upper drawer 25 in the exemplary embodiments described above, the present invention is not limited thereto. The front panel collision prevention mechanism may be provided to the right side plate of the upper drawer 25 alone, or to both the left side plate and the right side plate. In cases in which the front panel collision prevention mechanism is provided to both the left side plate and the right side plate of the upper drawer 25, the projection 54 of the front panel 12 can be more stably prevented from colliding with the lower casing 22.

Although description has been given for cases in which switching between the knock lever restriction state and the knock lever retracted state is achieved by operation of the stay in the exemplary embodiments described above, the present invention is not limited thereto. Switching between the knock lever restriction state and the knock lever retracted state may be achieved by the user operating the knock lever. However, when the knock lever swings coupled to operation of the stay, usability can be improved without forcing a complex operation on the user.

Although the spring 94 serves as a shock absorbing member in the fourth exemplary embodiment described above, the present invention is not limited thereto. For example, various materials capable of absorbing shock, such as gels, may be employed.

Although description has been given for cases in which the front panel 12 swings with respect to the upper drawer 25 in the exemplary embodiments described above, the present invention is not limited thereto. Switching between the front panel open state and the front panel closed state may be achieved by moving the front panel 12 up and down with respect to the upper drawer 25.

Description has been given for cases in which the present invention is applied to an automatic teller machine in which the upper unit 24 is pulled out from the upper casing 20 and the front panel 12 is swung in the exemplary embodiments described above. However, the present invention is not limited thereto, and the present invention may be applied to various devices that include a front panel that swings about a lower portion of a drawer that is pulled out from a casing, and in which there is a possibility of a portion of the front panel colliding with a specific location when housing the drawer in the casing.

Description has been given for cases in which the present invention is applied to an automatic teller machine in which the upper unit 24, 124, 224, and 324 is housed inside the upper casing 20 and pulled out to the exterior of the upper casing 20 in the exemplary embodiments described above.

The present invention is not limited thereto, and the present invention may, for example, be applied to an automatic teller machine wherein various sections, such as a banknote pay in/pay out mechanism or coin processor, are housed inside a casing and exposed to the exterior of the casing.

Description has been given for cases in which each type of processing out of conveying processing, housing processing, etc. are performed for banknotes as a medium in the automatic teller machine that performs transactions with cash such as banknotes in the exemplary embodiments described above.

However, the present invention is not limited thereto. For example, the present invention may also be applied to various devices that perform each type of processing out of conveying processing, housing processing, etc. on a thin paper shaped medium, such as shopping vouchers, cash vouchers, or entrance tickets.

Description has been given for cases in which automatic teller machine 1, 101, 201, and 301 serving as a transaction device is configured by the casing 10 serving as a casing, the upper unit 24, 124, 224, or 324 serving as a unit, the front panel 12 and the front panel frame 52 serving as a subunit, and the front panel collision prevention mechanism 70, 170, 270, or 370 serving as a push-in restriction section in the exemplary embodiments described above.

However, the present invention is not limited thereto. A drawer device may be configured by casing, units, subunits, and push-in restriction sections having various other configurations.

Description has been given for cases in which the automatic teller machine 1, 101, 201, 301 serving as a medium transaction device is configured by the upper casing 20 serving as an upper casing, the lower casing 22 serving as a lower casing, the upper unit 24, 124, 224, or 324 serving as a unit, the customer interface 13 serving as a customer interface, the front panel 12 and the front panel frame 52 serving as a subunit, and the front panel collision prevention mechanism 70, 170, 270, or 370 serving as a push-in restriction section.

However, the present invention is not limited thereto. Configuration of the medium transaction device may be made from upper casings, lower casing, units, customer interfaces, subunits, and push-in restriction sections having various other configurations.

The disclosure of Japanese Patent Application No. 2013-064441 is incorporated herein by reference in its entirety.

All publications, patent applications and technical standards mentioned in the present specification are incorporated by reference in the present specification to the same extent as if the individual publication, patent application, or technical standard was specifically and individually indicated to be incorporated by reference patent application. Industrial Applicability The present invention can be employed in various machines that include a drawer mechanism that executes specific processing in a state housed in a casing, and in which a portion or all of the drawer mechanism can be exposed by pulling out the drawer mechanism from the casing during operations such as maintenance.

The invention claimed is:

1. A drawer device, comprising:

a casing including a specific internal space;

a unit that adopts a pulled out state by being pulled out forward from a housed state of being housed in the casing;

a subunit in the unit that adopts an open state in which the unit interior is open to the outside by swinging in an opening direction, and that adopts a closed state in which the unit interior is closed off from the outside by swinging in a closing direction; and a push-in restriction section that restricts movement of the unit toward the casing when the unit is moved toward the casing with the subunit still in the open state, wherein the push-in restriction section contacts the casing to prevent from the subunit contacting the casing when the unit is moved toward the casing with the subunit still in the open state; and wherein the subunit swings about a pivot point in the vicinity of a lower end portion of the unit.

2. The drawer device of claim 1, further comprising a stay that swings the subunit in the opening direction with respect to the unit, and supports the open state, wherein the push-in restriction section is capable of moving while coupled to the stay.

3. The drawer device of claim 2, wherein the push-in restriction section restricts movement of the unit toward the casing when the stay is supporting the open state of the subunit, and is turned by the stay in the closed state of the subunit to release restriction of movement of the unit toward the casing.

4. The drawer device of claim 1, further comprising a swing restricting portion that restricts swinging of the subunit with respect to the unit in the housed state of the unit, and releases restriction of swinging of the subunit with respect to the unit in the pulled out state of the unit.

5. The drawer device of claim 4, wherein the swing restricting portion restricts swinging of the subunit with respect to the unit in the housed state of the unit by insertion of a rear end portion of an upper portion of the subunit at a lower side of a top plate of the casing.

6. The drawer device of claim 1, wherein the push-in restriction section is provided at both a left side and a right side of the unit.

7. The drawer device of claim 1, wherein the push-in restriction section further includes a shock absorbing member that alleviates an impact received when the push-in restriction section contacts the casing.

8. The drawer device of claim 1, wherein the subunit adopts the open state by swinging in the opening direction, and adopts the closed state by swinging in the closing direction, on a front face of the unit, wherein the pivot point is a shaft provided extending left and right in the vicinity of the lower end portion at the front face side of the unit.

9. A medium transaction device, comprising:

an upper casing including a specific interior space;

a lower casing that is disposed below the upper casing and that internally stores a medium cassette that houses a paper sheet-shaped medium;

a unit that adopts a pulled out state by being pulled out forward from a housed state of being housed in the upper casing;

a customer interface that is provided at the unit and that receives transactions related to the medium;

a subunit in the unit that adopts an open state in which the unit interior is open to the outside by swinging in an opening direction, and that adopts a closed state in which the unit interior is closed off from the outside by swinging in a closing direction; and a push-in restriction section that restricts movement of the unit toward the upper casing when the unit is moved toward the upper casing with the subunit still in the open state, wherein the push-in restriction section contacts the upper casing to prevent from the subunit contacting the upper casing when the unit is moved toward the upper casing with the subunit still in the open state; and wherein the subunit swings about a pivot point in the vicinity of a lower end portion of the unit.

10. The medium transaction device of claim 9, wherein the subunit adopts the open state by swinging in the opening direction, and adopts the closed state by swinging in the closing direction, on a front face of the unit, wherein the pivot point is a shaft provided extending left and right in the vicinity of the lower end portion at the front face side of the unit.

11. A drawer device, comprising:

a casing including a specific internal space;

a unit that adopts a pulled out state by being pulled out forward from a housed state of being housed in the casing;

a subunit in the unit that adopts an open state in which the unit interior is open to the outside by swinging in an opening direction, and that adopts a closed state in which the unit interior is closed off from the outside by swinging in a closing direction; and a push-in restriction section that restricts movement of the unit toward the casing when the unit is moved toward the casing with the subunit still in the open state, wherein the subunit swings about a pivot point in the vicinity of a lower end portion of the unit.

* * * * *